US007679564B2

(12) United States Patent
Chang et al.

(10) Patent No.: US 7,679,564 B2
(45) Date of Patent: Mar. 16, 2010

(54) MULTI-BAND ANTENNA

(75) Inventors: Hung-Yue Chang, Taipei Hsien (TW); Chen-Hsing Fang, Taipei Hsien (TW); Wei-Li Cheng, Taipei Hsien (TW); Chih-Lung Chen, Taipei Hsien (TW)

(73) Assignee: Wistron NeWeb Corp., Hsinchu (TW)

( * ) Notice: Subject to any disclaimer, the term of this patent is extended or adjusted under 35 U.S.C. 154(b) by 43 days.

(21) Appl. No.: 11/624,221

(22) Filed: Jan. 18, 2007

(65) Prior Publication Data

US 2007/0115184 A1 May 24, 2007

Related U.S. Application Data

(62) Division of application No. 11/161,999, filed on Aug. 25, 2005, now Pat. No. 7,209,081.

(30) Foreign Application Priority Data

Jan. 21, 2005 (TW) ..... 94101770 A

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895
See application file for complete search history.

(56) References Cited

U.S. PATENT DOCUMENTS

| | | | | |
|---|---|---|---|---|
| 6,127,977 | A * | 10/2000 | Cohen | 343/700 MS |
| 6,812,892 | B2 * | 11/2004 | Tai et al. | 343/700 MS |
| 6,937,192 | B2 * | 8/2005 | Mendolia et al. | 343/700 MS |
| 7,333,067 | B2 * | 2/2008 | Hung et al. | 343/770 |
| 2003/0034918 | A1 * | 2/2003 | Werner et al. | 343/700 MS |

* cited by examiner

*Primary Examiner*—Douglas W Owens
*Assistant Examiner*—Dieu Hien T Duong
(74) *Attorney, Agent, or Firm*—Jianq Chyun IP Office

(57) ABSTRACT

The present invention provides a multi-band antenna to which the arrangement of Koch fractal antenna is applied. The multi-band antenna is designed in triangular shape whose area is smaller than the general antenna structure. By using the arrangement of Koch fractal antenna, the area of the inverted-F dual-band antenna can be reduced efficiently, so as to enhance more usability.

7 Claims, 8 Drawing Sheets

MULTI-BAND ANTENNA

CROSS-REFERENCE TO RELATED APPLICATION

This is a divisional application of patent application Ser. No. 11/161,999, filed on Aug. 25, 2005, which claims the priority benefit of Taiwan patent application serial no. 94101770, filed on Jan. 21, 2005 and is now allowed. The entirety of each of the above-mentioned patent applications is hereby incorporated by reference herein and made a part of this specification.

BACKGROUND OF THE INVENTION

1. Field of the Invention

The present invention relates to a multi-band antenna, and more particularly, to a multi-band antenna using a Koch fractal antenna technology.

2. Description of the Related Art

Since the wireless communication technology of using electromagnetic wave to transmit signals has the effect of remote device transmission without cable connection, and further has the mobility advantage, therefore the technology is widely applied to various products, such as mobile phones, notebook computers, intellectual home appliance with wireless communication features. Because these devices use electromagnetic wave to transmit signals, the antenna used to receive electromagnetic wave also becomes a necessity in the application of the wireless communication technology.

FIG. 1 shows a comparison between a conventional Koch fractal antenna and a monopole antenna. Referring to FIG. 1, the conventional monopole antenna 101 is stretched outwards from its center portion for reducing the antenna size, so that an equilateral triangle is formed at the center of the original monopole antenna 101, occupied one-third portion of the monopole antenna 101. As shown in FIG. 1, the antenna 120 is a result of stretching the monopole antenna 101 from its center. In the FIG. 1, the antenna 123 is the equilateral triangle mentioned above, in which the length sum of the triangle sides is exactly one-third of the whole length of the original monopole antenna 101.

In this method, each side of the antenna 120 can be further stretched, to form the antenna 130 as shown in FIG. 1, wherein the side length of the equilateral triangle 133 formed by stretching the antenna 130 is one-third of each side of the original antenna 120. Thus, the shape of the antenna 140 can be formed by repeating the above steps. The antenna formed by the above method is a so-called Koch fractal antenna. The Koch fractal antennas of different arrangement can be designed by stretching the antenna repeatedly for different times.

After the original monopole antenna is stretched for different times, different operation wave lengths can be obtained. Therefore, the area occupied by the monopole antenna can be reduced by stretching the monopole antenna for different times, and also the required operation frequency can be achieved. Thus, the antenna can be minimized and implemented to fit different devices. However, such Koch fractal antenna design only enables the antenna to work in a single band, and cannot transmit and receive multi-band signals simultaneously.

FIG. 2 shows a conventional inverted-F dual-band antenna. In FIG. 2, the conventional inverted-F dual-band antenna comprises a radiation element 301, a grounding element 303, a conductive pin 305 and a signal wire 307. The radiation element 301 is a straight wire made of electrically conductive material to receive and transit signals with two frequencies f1 and f2. The length of the radiation element 301 is determined by the two different frequencies f1 and f2, and the radiation element 301 can be further divided into a first section 311 resonating at the first frequency f1, and a second section 309 resonating at the second frequency f2. The first frequency f1 is different from the second frequency f2. The length l1 of the first section 311 is approximately one-fourth of the wavelength λ1 of the first frequency f1, while the length l2 of the second section 309 is approximately one-fourth of the wavelength λ2 of the second frequency f2.

The grounding element 303 is a conductive plate underneath and separated from the radiation element 301 with a gap. The conductive pin 305 is connected to the radiation element 301 and grounding element 303 to form an N-shape structure. One end of the signal wire 307 is connected to the conductive pin 305 to receive or transmit electromagnetic waves. Even though this inverted-F dual-band antenna can be adapted in receiving and transmitting signals with two different operation frequencies, the radiation element 301 therein cannot be further shrunk or deformed. Therefore, inverted-F dual-band antenna cannot fit into small devices. Accordingly, such design is relatively inconvenient.

SUMMARY OF THE INVENTION

The object of the present invention is to provide a multi-band antenna which uses the Koch fractal antenna arrangement to reduce the area required by the antenna. In addition, the design of multi-band antenna can also be made through the Koch fractal antenna arrangement.

Another object of the present invention is to provide a design method of multi-band antenna. The Koch fractal antenna structure is used to design a multi-band antenna in a triangle arrangement, which has a smaller area than the regular antenna structure.

Another object of the present invention is to provide a multi-band antenna, in which the Koch fractal antenna structure is used to design an inverted-F dual-band antenna even smaller than the conventional one. In this way, the area occupied by the antenna can be reduced.

The present invention provides a multi-band antenna, comprising a medium plate, a ground metal plane, an antenna and a signal feed-in module. The medium plate has a first surface and a second surface, and the ground metal plane is located on the second surface of the medium plate. The above antenna has M (M is a real number) fractal radiation elements which are located on the first surface of the medium plate, and each of the fractal radiation elements has an input end, and transmits signals within different frequencies.

The aforementioned M fractal radiation elements are evolved by winding inwardly for multiple rounds along a geometric locus and gradually narrowing to form a fundamental pattern. The geometric locus along which the fractal radiation elements wind has the same center of gravity and is not overlapped. The above feed-in module has M signal feed-in wires, each of which is connected and transmits signals to the corresponding fractal radiation element.

In an embodiment of the present invention, the geometric locus mentioned above is a regular triangle locus. The above fractal evolution comprises N (N is a positive integer) stages of stretching, in which each stage of the stretching takes place at each straight line section of each of fractal radiation elements. Right at the middle of each predetermined length of interval, the straight line section within the predetermined length is stretched towards its vertical direction, so that a sharp locus is protruded within the predetermined length.

In an embodiment of the present invention, the above protruding sharp locus is an equilateral triangle locus, while the above predetermined length is the length of the straight line section corresponding to each of the fractal radiation elements, during the current stage stretching.

In an embodiment of the present invention, the above fractal radiation element can be a micro-strip component.

Additionally, the present invention provides a design method for a multi-band antenna which comprises a medium plate, a ground metal plane, an antenna and a signal feed-in module. The medium plate has a first surface and a second surface, and the ground metal plane is located on the second surface of the medium plate. The above antenna has M fractal radiation elements (M is a real number) which are located on the first surface of the medium plate, and each fractal radiation element has an input end and transmits signals having different frequencies.

Each fractal radiation element is evolved by winding for a plurality of rounds inwardly along a geometric locus and gradually narrowing to form a fundamental pattern. The geometric loci along which the fractal radiation element winds have the same center of gravity and are not overlapped. The signal feed-in module has M signal feed-in wires, each of which connects and transmits signals to the corresponding fractal radiation element. The design method for such multi-band antenna comprises steps of step (a): on each straight line section of each fractal radiation element and at the central position of each predetermined length of interval, stretching the straight line section vertically within the predetermined length with respect to the straight line section, so that a sharp locus is protruded within the predetermined length; and step (b): repeating the step (a) for N times, wherein N is a positive integer.

In an embodiment of the present invention, the above geometric locus can be a regular triangle locus, while the protruding sharp locus is an equilateral triangle. In addition, the above predetermined length refers to the length of the straight line section corresponding to each of the fractal radiation elements corresponding to the current stage stretching.

The present invention further provides a multi-band antenna comprising a radiation element, a grounding element, a conductive pin and a signal wire. The grounding element is located on one side of the radiation element with a gap therebetween. The conductive pin comprises a first branch arm, a second branch arm and a third branch arm. The first end of the first branch arm is coupled with the radiation element, the second branch arm is isolated from the first branch arm, the second end of the second branch arm is coupled with the grounding element, the first end of the third branch arm is coupled with the second end of the first branch arm, and the second end of the third branch arm is coupled with the first end of the second branch arm. The signal wire is coupled with the conductive pin to receive and transmit signals. The radiation element has a predetermined length which is equally divided in to a plurality of equal length, and a fractal evolution is performed for each predetermined length.

In an embodiment of the present invention, the above fractal evolution comprise performing N (N is a positive integer) stages of stretching, and each stage stretching takes place at each of the straight line sections of the fractal radiation elements. The stretching process is performed for the straight line section of each predetermined length, thus a protruding sharp locus is formed within the predetermined length.

In an embodiment of the present invention, the above protruding sharp locus is an equilateral triangle, and the predetermined length refers to the length of the straight line section of the fractal radiation element corresponding to the current stage stretching. In addition, the fractal radiation element is a micro-strip.

In an embodiment of the present invention, the third branch arm of the conductive pin is vertical to the first branch arm and the second branch arm, and the first branch arm is parallel to the second branch arm. In addition, the radiation element is parallel to the grounding element.

In summary, according to the multi-band antenna of the present invention, the Koch fractal antenna design method can be used to design the antenna using a triangle arrangement to reduce the area occupied by the antenna, and also to achieve effects of receiving and transmitting signals with different frequencies. Moreover, the area occupied by the antenna can also be reduced if such Koch fractal antenna structure utilizing the triangle arrangement method is applied to the inverted-F dual-band antenna, thus the utility of the inverted-F dual-band antenna can be enhanced.

These and other exemplary embodiments, features, aspects, and advantages of the present invention will be described and become more apparent from the detailed description of exemplary embodiments when read in conjunction with accompanying drawings.

DETAIL DESCRIPTION OF THE EMBODIMENTS

The most significant feature of the multi-band antenna of the present invention is that the antenna is designed by utilizing the Koch fractal antenna structure, and by winding for a plurality of rounds to form triangles. Therefore, the area required by the antenna can be efficiently reduced, and the multi-band operation can further be achieved.

Figure 1:
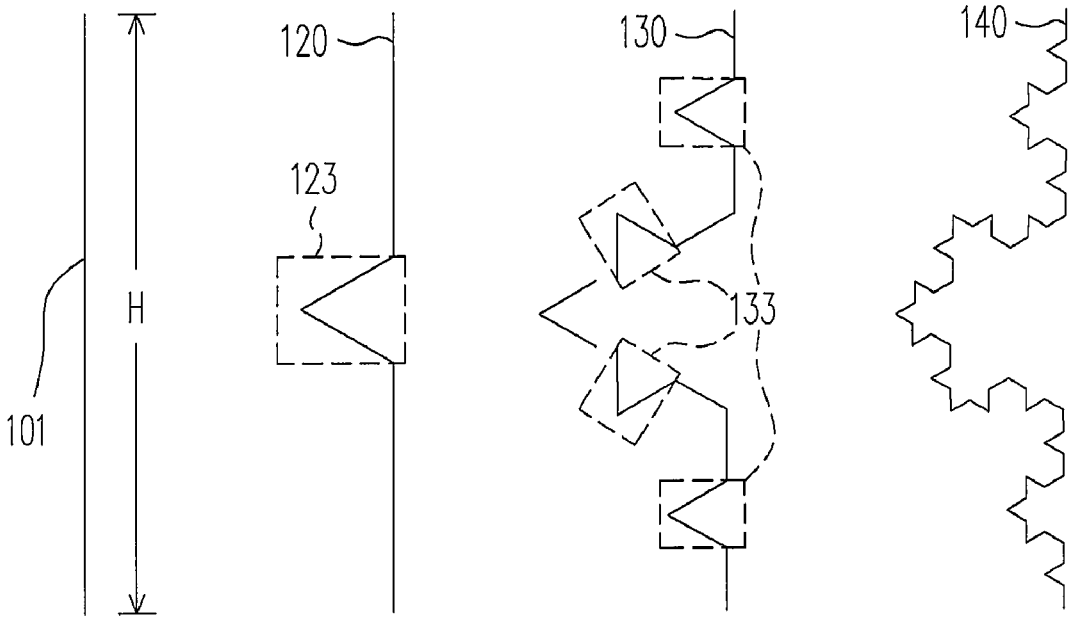
FIG. 1 (PRIOR ART)
FIG. 1 illustrates a comparison diagram between a conventional Koch fractal antenna and a monopole antenna.
Figure 2:
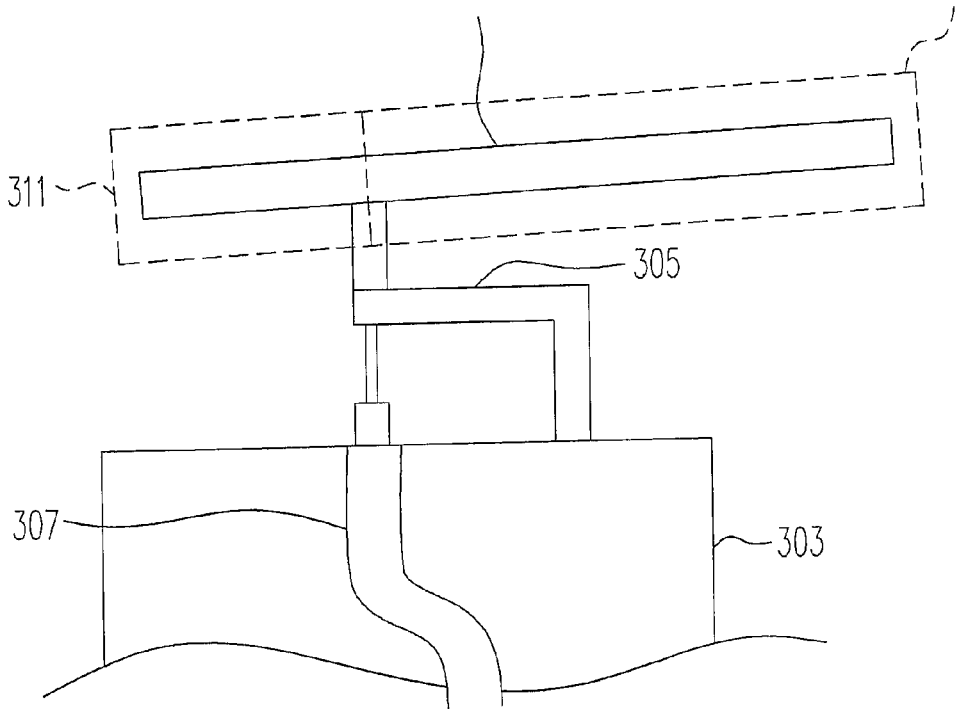
FIG. 2 (PRIOR ART)
FIG. 2 illustrates a conventional inverted-F dual-band antenna.
Figure 3:
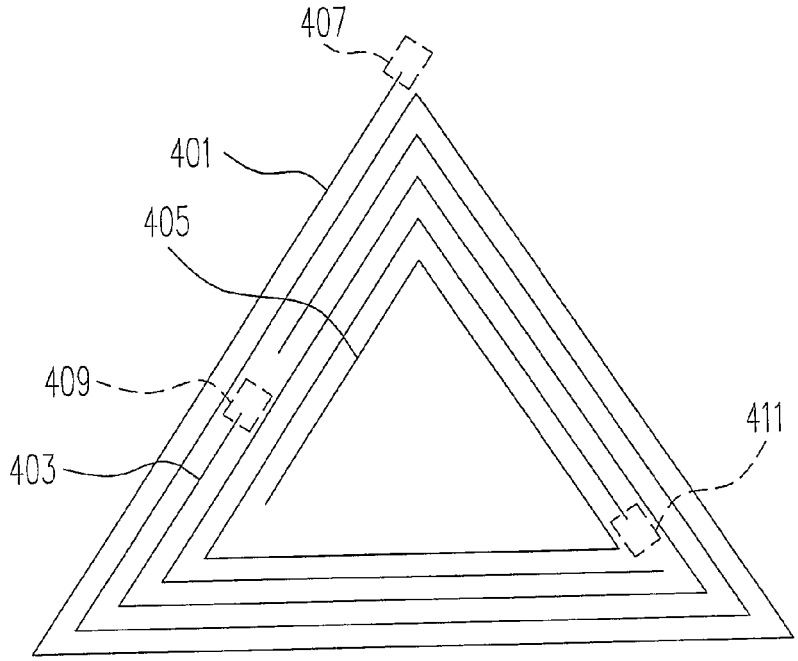
FIG. 3 illustrates a structure diagram of a multi-band antenna according to the present invention.

FIG. 3 illustrates a structure of the multi-band antenna of the present invention. In FIG. 3, the multi-band antenna comprises three radiation elements 401, 403 and 405, for example. The three radiation elements are all designed by winding for a plurality of rounds along the same geometric locus. In the present embodiment, the geometric locus is a regular triangle. These radiation elements respectively have input ends 407, 409 and 411 to receive and transmit signals with different frequencies.

The regular triangle loci wound by each of the radiation elements have the same center of gravity, but different perpendicular bisectors. The principle of winding each radiation elements into the equilateral triangle locus is that the length of the perpendicular bisector of the outer triangle locus must be greater than the perpendicular bisector of the inner regular triangle. In addition, the length of the perpendicular bisector of all the regular triangle loci wound by the outer radiation elements must be longer than the length of the perpendicular bisector of all the regular triangle loci wound by the inner radiation elements.

In FIG. 3, the length of the perpendicular bisector of all regular triangle loci wound by the radiation elements 401 must be greater than the length of the perpendicular bisector of all regular triangle loci wound by the radiation element 403. Thus, it can be sure that in the antenna, all the regular triangle loci wound by the radiation elements are not overlapped. In addition, in the present embodiment, micro-strips can be used as the radiation elements 401, 403 and 405. Moreover, the regular triangle locus is an example in the above embodiment, and the geometric shape of the radiation element can be any triangle locus.

Figure 4:
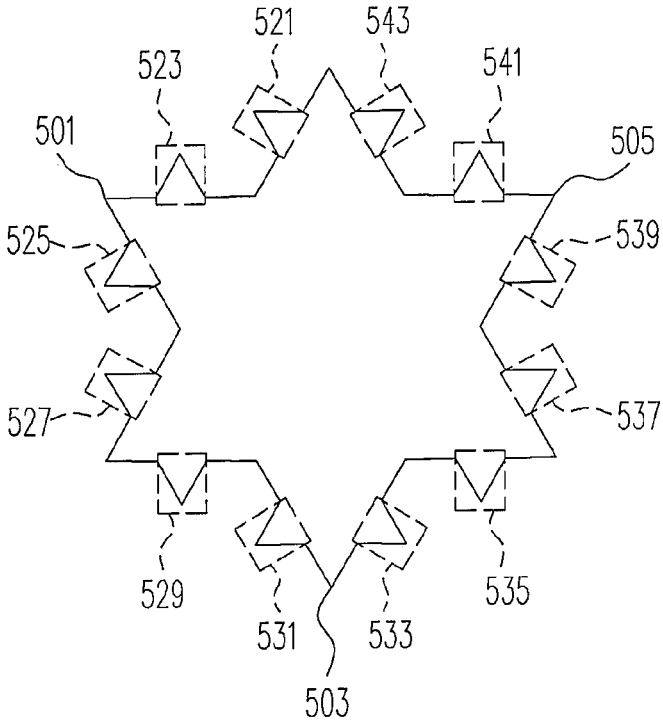
FIG. 4 illustrates a detail structure of the multi-band antenna according to the present invention.

FIG. 4 shows a detail structure of the multi-band antenna of the present invention. In FIG. 4, the radiation element 401 of FIG. 3 is described to more clearly explain how the design principle of the Koch fractal antenna is applied in the present embodiment.

The triangle loci in FIG. 4 are formed in a manner that the radiation element 401 is wound for N times. In order to adjust the operation frequency of the radiation element 401, each side of the regular triangle locus can be stretched outwards every predetermined length. In the present embodiment, the predetermined length is one-third of the side length of the regular triangle. Therefore, the side of the triangle in FIG. 4 may be stretched outwards from its central position, so that the first protruding sharp loci 501, 503 and 505 are formed at the central portions of respective sides, and each of loci 501, 502, 503 occupies one-third length of the side length of the regular triangle. The first protruding sharp locus is defined as the first regular triangle locus whose total side length is exactly one-third of the side length of the regular triangle.

Therefore, after the above stretching process, each side of the original regular triangle is transformed into four line segments, in which the length of each line segment is exactly one-third of the side length of the original regular triangle locus. Again, according to the design principle of the Koch fractal antenna, the four line segments are respective stretched outwards from their corresponding central portion of the line segments, so that second protruding sharp loci 521-543 are formed at the central portion, and the length of each of the second protruding sharp loci 521-543 is one-third of the length of the line segment.

The second protruding sharp locus is defined as the second equilateral triangle locus whose side length is exactly one-third of the side length of the first equilateral triangle. After two stretching processes described above, each side of the original regular triangle is transformed into 16 line segments, in which each side length is exactly one-ninth of the side length of the original regular triangle locus.

According to the method described above, the radiation element 401 can be further stretched for a plurality of times, so that a radiation element with a different operation frequency can be obtained. However, for such multi-band antenna, since there is a severe interference among the radiation elements, the number of winding rounds and stretching must be to optimize the antenna efficiency. As described above, a tri-band antenna is used as an example, and for those skilled in the art, an antenna with more operation frequencies can be also designed based on this method.

Figure 5:
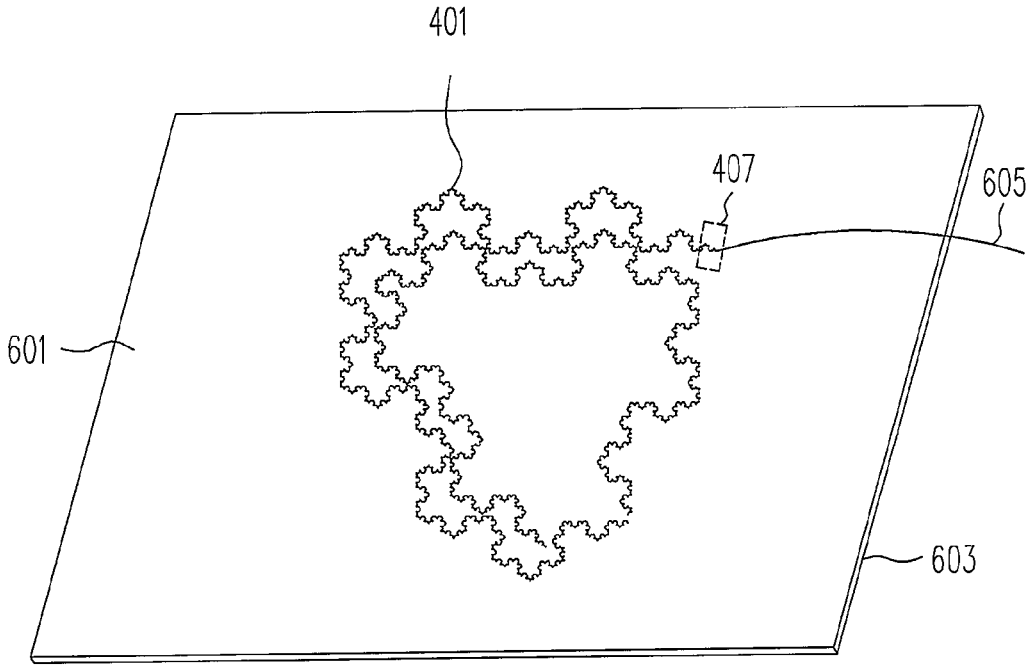
FIG. 5 illustrates a complete structure of the multi-band antenna according to the present invention.

FIG. 5 shows a complete structure of the multi-band antenna according to the present invention. In FIG. 5, the multi-band antenna comprises a medium plate 601 and a metal ground plane 603, in which medium plate 601 has a first surface and a second surface, and the metal ground plane 603 is located on the second surface of the medium plate 601. The radiation element 401 is located on the first surface of the medium plate 601. A signal feed-in wire 605 is coupled to the input end 407 to transmit and receive signals. In FIG. 5, the radiation element 401 is made by winding twice and stretched four times.

Figure 6:
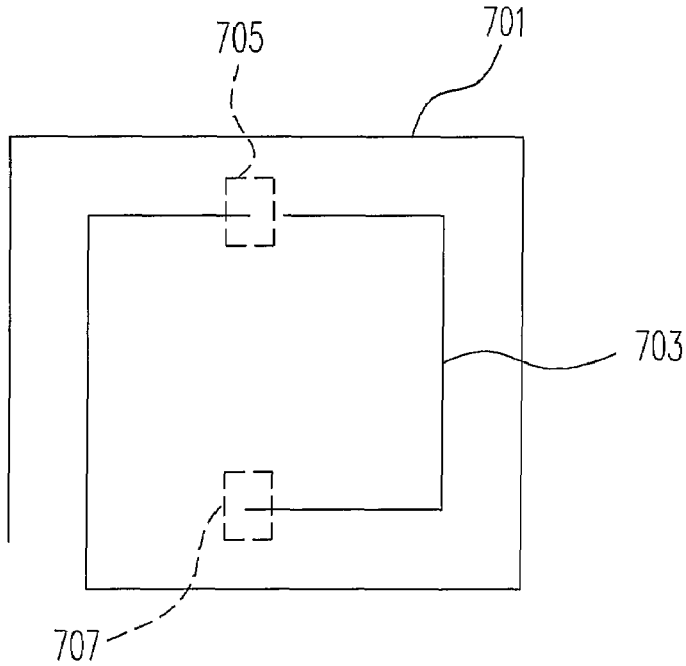
FIG. 6 illustrates a structure diagram of another multi-band antenna according to the present invention.

FIG. 6 shows a structure diagram of another multi-band antenna according to the present invention. In FIG. 6, such antenna comprises two radiation elements 701 and 703. The two radiation elements are also wound for a plurality of rounds and have the same geometric locus. The geometric locus shown in the present embodiment is a square locus. For the square locus where each of the radiation elements is wound, the side length of the square locus at the outer side must be greater than the side length of the square locus at the inner side. The side lengths of all of the squares where the outer-side radiation elements surround also must be greater than the side lengths of all of the squares where the inner side radiation elements surround.

In FIG. 6, the side length of the square locus wound by the radiation element 701 must be greater than the side length of the square locus wound by the radiation element 703. Thus the radiation element 701 and the radiation element 703 are not overlapped. Although the square locus is used for describing the above embodiment, other polygonal loci can be also suitably chosen as the geometric shape of the radiation element according to the above method.

In order to adjust the operation frequencies of the radiation elements 701 and 703, each side of the radiation elements 701 and 703 can be stretched in the same way as described in FIG. 4. According to the above method, the radiation elements 701 and 703 can be further stretched for a plurality of times on the same side, so that the radiation element with a different operation frequency can be formed. Similarly, since there is a relatively severe interference among the radiation elements, the number of winding rounds and stretching must be adjusted to optimize the antenna efficiency.

Figure 7:
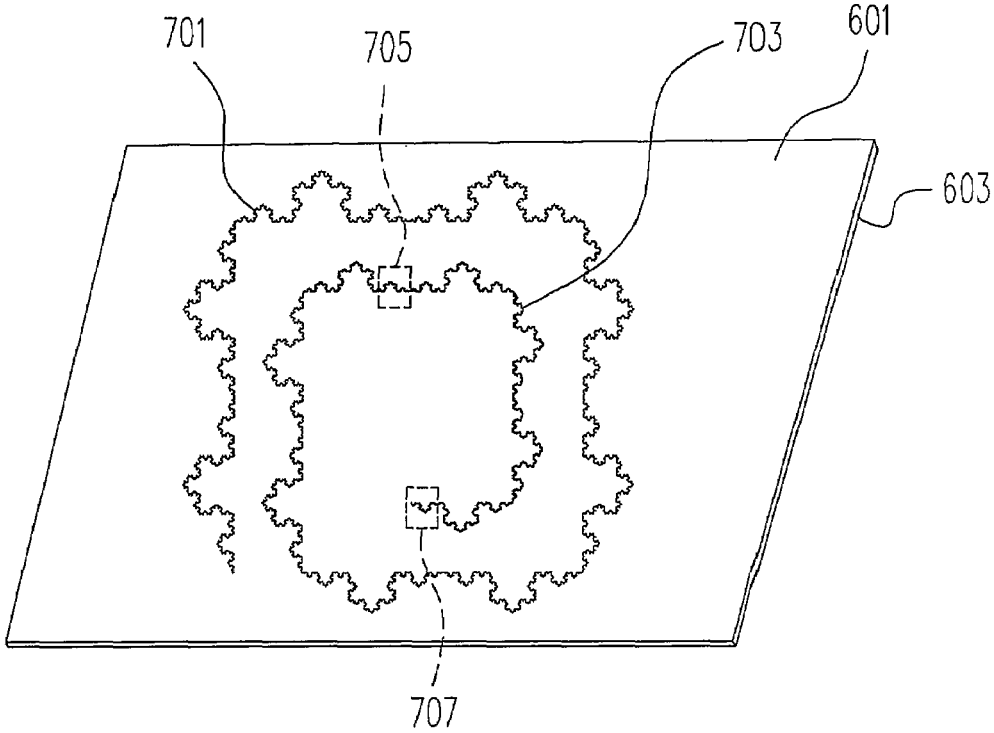
FIG. 7 illustrates a complete structure of the multi-band antenna according to FIG. 6.

FIG. 7 shows a complete structure of the multi-band antenna according to the FIG. 6. In FIG. 7, the multi-band antenna also has a medium plate 601 having a first surface and a second surface. A ground plane 603 is located on the second surface, and the radiation elements 701 and 703 are located on the first surface of the medium plate 601. The signal feed-in wires are respectively coupled to the input end 705 and 707 to transmit and receive signals.

Figure 8:
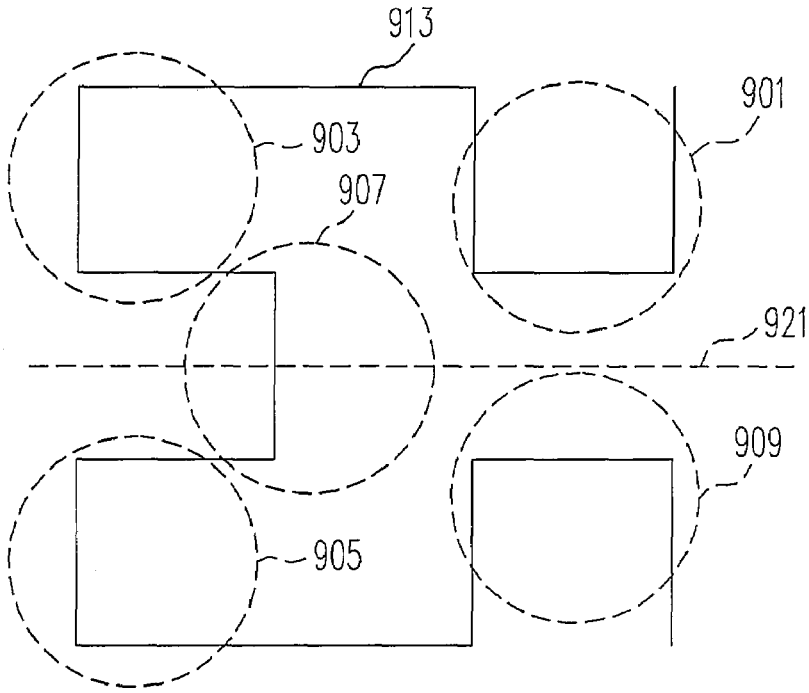
FIG. 8 illustrates a diagram of still another type of multi-band antenna according to the present invention.

FIG. 8 shows a diagram of another multi-band antenna according to the present invention. In FIG. 8, a multi-band antenna 913 is transformed according to a Hilbert Curve antenna structure. Viewing from the separating line 921, the antenna is composed of U-shaped structures whose upper and lower parts are symmetrical and has a leftward opening. In this embodiment, five U-shaped structures 901~909 are presented.

Figure 9:
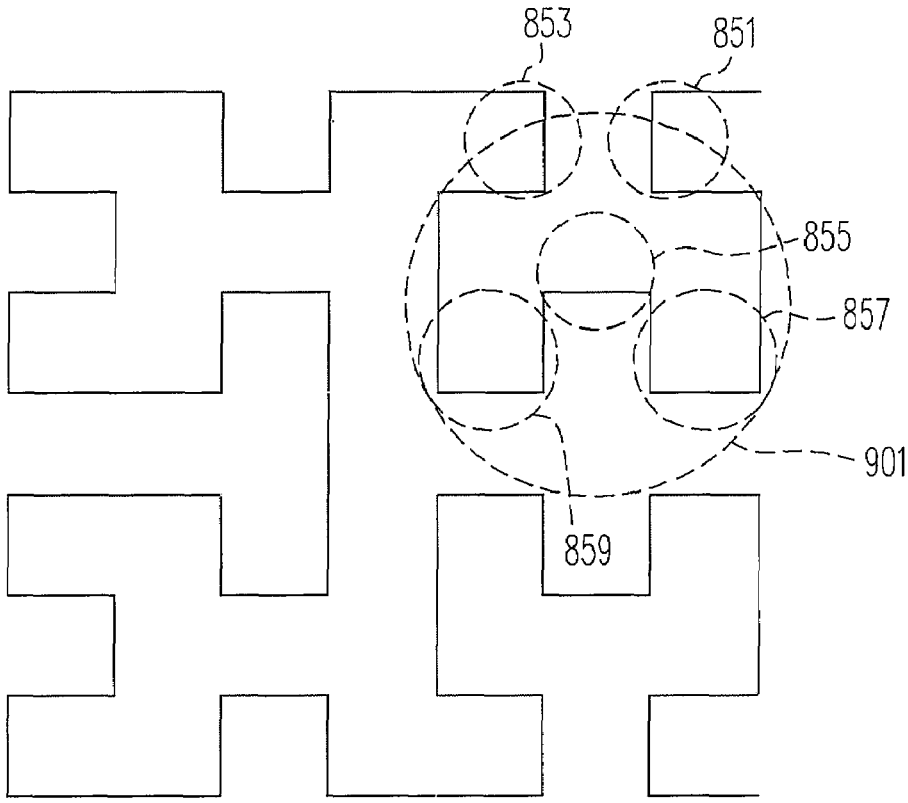
FIG. 9 illustrates a diagram of the multi-band antenna in FIG. 8 being stretched once.

FIG. 9 is a diagram of a multi-band antenna after the antenna structure in FIG. 8 is stretched once. In FIG. 9, the stretching is first described with the U-shaped structure 901. After each side of the U-shaped structure 901 is stretched, the U-shaped structure 901 further comprises five U-shaped structures 851~859. Of course, the other four U-shaped structure 903~909 would also be transformed into the structure comprising five smaller U-shaped structures if they are stretched in the same way.

Figure 10:
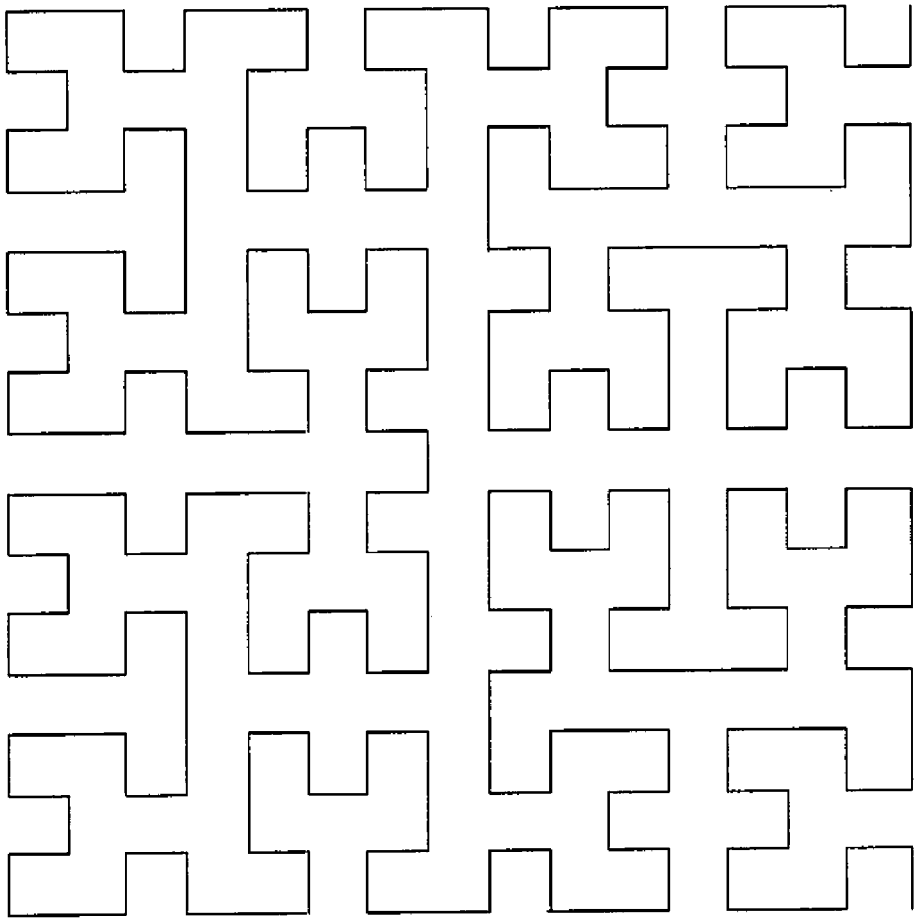
FIG. 10 illustrates a diagram of the multi-band antenna of FIG. 8 after being stretched for a plurality of times.

FIG. 10 shows a structure diagram of a multi-band antenna after the antenna structure in FIG. 8 is stretched for a plurality of times. In this embodiment, when such multi-band antenna is stretched for a plurality of times according to the above method, the final structure is shown in FIG. 10. According to the above method, the designer can stretch the Hilbert Curve antenna 913 for different times to adjust the antenna to have the predetermined band without occupying too much area.

Figure 11:
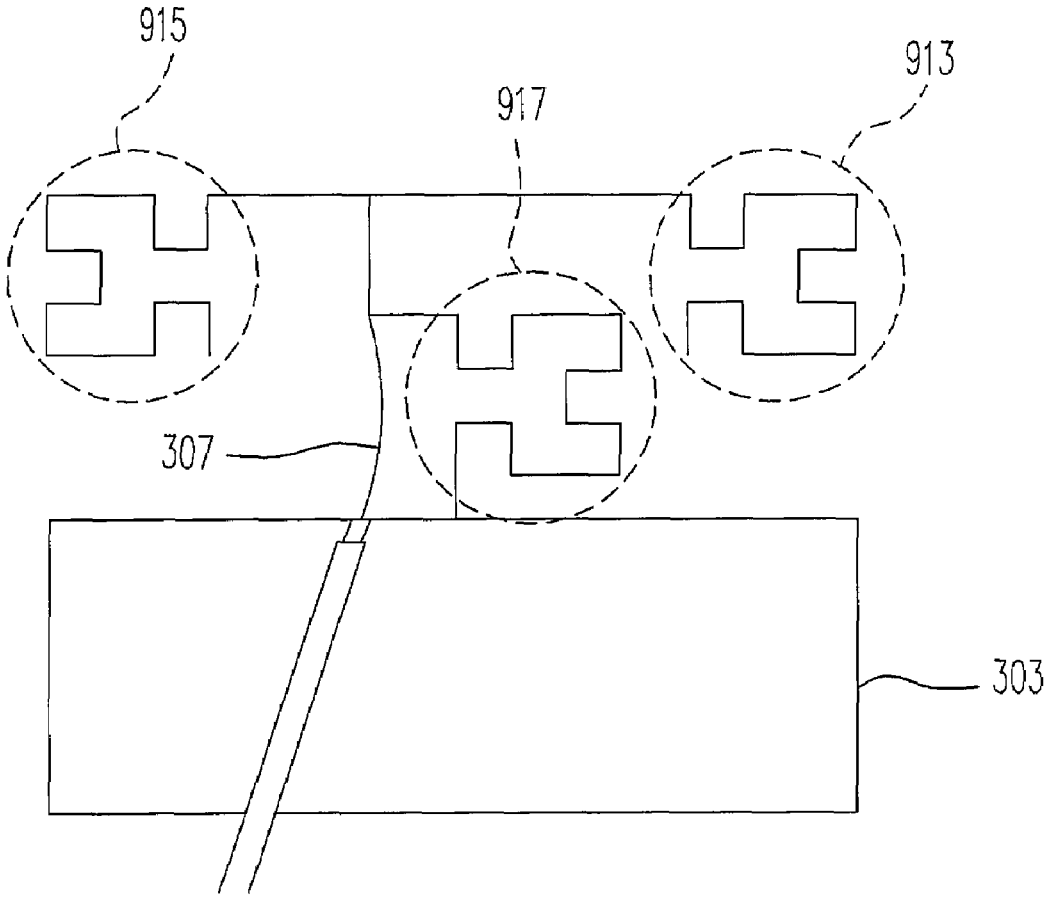
FIG. 11 illustrates a complete structure of the multi-band antenna of FIG. 8.

FIG. 11 shows a complete structure diagram of the multi-band antenna in FIG. 8. In FIG. 11, the multi-band antenna comprises three Hilbert Curve antennas 913, 915, 917. The signal wire 307 passes through the grounding element 303 to transmit signals to the Hilbert Curve antennas 913, 915 and 917. These Hilbert Curve antennas 913, 915, 917 may be stretched for different times respectively using the above stretching method, so that these antennas 913, 915, 917 can be operated at different bands to effect the multi-band operation. Even though a tri-band antenna is used as an example in the above description, other types of multi-band antennas may be designed using this technology by those skilled in the art.

Figure 12:
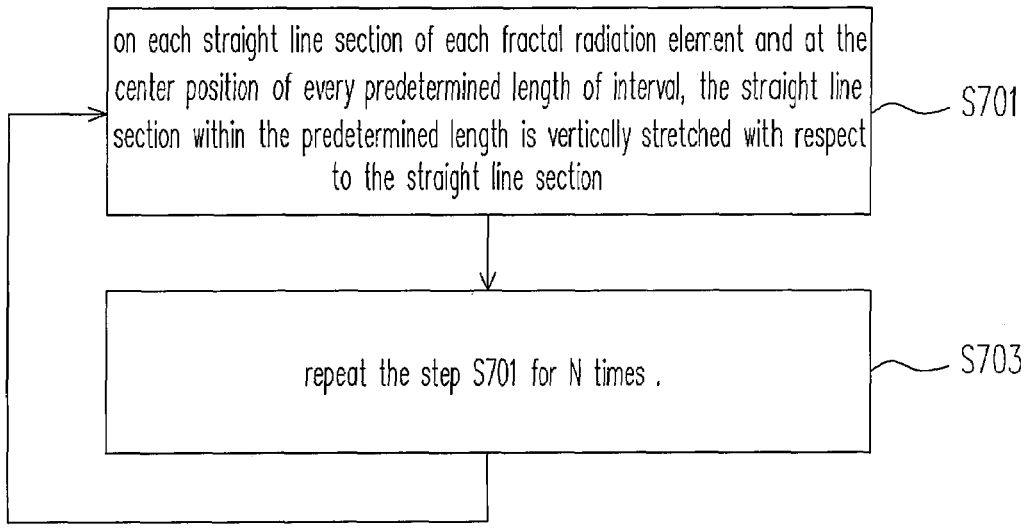
FIG. 12 illustrates a flow chart of the design method of a multi-band antenna according to the present invention.

FIG. 12 shows a flow chart for designing a multi-band antenna according to the present invention. The multi-band antenna comprises a medium plate, a ground metal plane, an antenna and a signal feed-in module. The medium plate has a first surface and a second surface, and the ground metal plane is located on the second surface of the medium plate, while the antenna with M fractal radiation elements is located on the first surface. Each of the fractal radiation elements has an input end and transmits signals of different frequencies.

Each of the fractal radiation elements is formed by winding inward for N rounds while narrowing gradually along a geometric locus. In the present embodiment, the previously described geometric locus is a square or triangle locus. The regular triangles wound by the fractal radiation elements have the same center of gravity and do not overlap The signal feed-in module has M signal feed-in wires, each of which connects to the corresponding fractal radiation element and transmits signals thereto.

First, at step S701, on each straight line section of each fractal radiation element and at the center position of every predetermined length of interval, the straight line section within the predetermined length is vertically stretched with respect to the straight line section. As a result, a protruding sharp locus is formed within the predetermined length. At step S703, the step S701 is repeated for N times, wherein the N is a positive integer.

The protruding sharp locus as mentioned at step S701 is an equilateral triangle locus, and the predetermined length is the length of the straight line section corresponding to the fractal radiation element corresponding to the current stretching.

Figure 13:
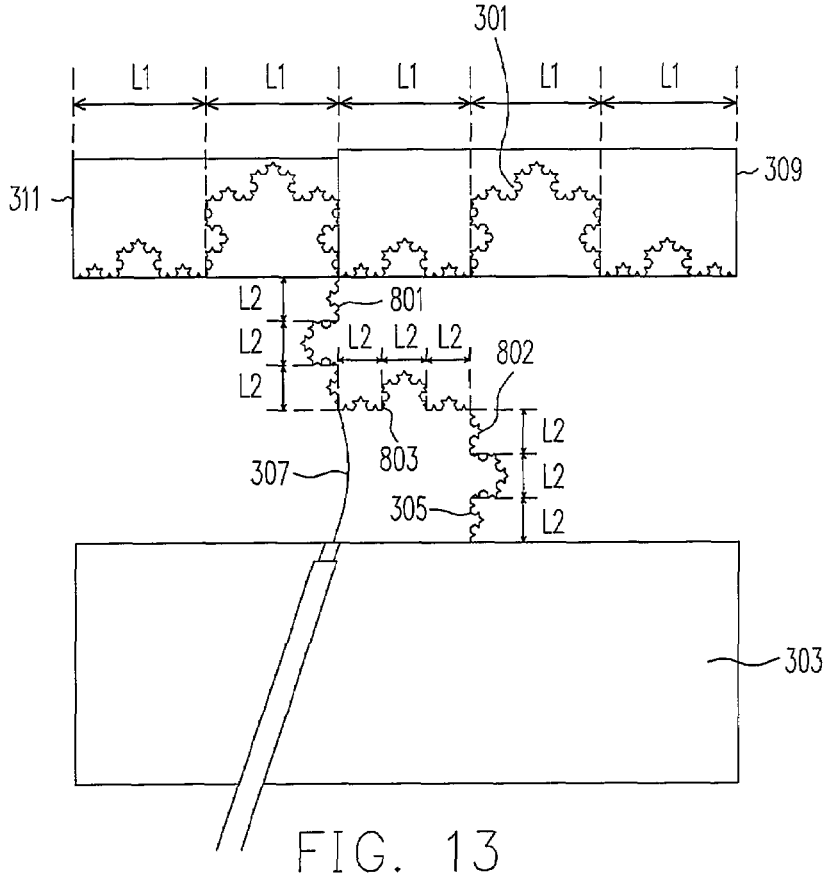
FIG. 13 illustrates a structure diagram of an inverted-F dual-band antenna in which the multi-band antenna is applied according to the present invention.

According to the above description, both the length and the operation frequency of the original antenna can be changed by utilizing the Koch fractal antenna design method and the regular stretching, so that the application of the antenna can be more flexible. How to apply the Koch fractal antenna design method to the conventional inverted-F dual-band antenna is discussed below. With reference to FIG. 13, the fractal structure diagram of the inverted-F dual-band antenna is achieved by utilizing the method of the present invention.

As shown in the FIG. 13, the inverted-F dual-band antenna comprises a radiation element 301, a grounding element 303, a conductive pin 305 and a signal wire 307. The radiation element 301 comprises a micro-strip to receive and transmit signals with two different frequencies f1 and f2. The length of the radiation element 301 is determined by the two different frequencies, and can be divided into a first section 311 that resonates at the first frequency f1 and a second section 309 that resonates at the second frequency f2. The first frequency f1 is different from the second frequency f2. The length l1 of the first section 311 is approximately one-fourth of the wavelength λ1 of the first frequency f1, while the length l2 of the second section 309 is approximately one-fourth of the wavelength λ2 of the second frequency f2.

The grounding element 303 is an electric conducting chip which is located beneath the radiation element 301 with a gap therebetween. The conductive pin 305 connects to the radiation element 301 and the grounding element 303 in an N-shape structure. One end of the signal wire 307 connects to the conductive pin 305 to receive and transmit electromagnetic wave.

The conductive pin 305 further comprises a first branch arm 801, a second branch arm 802 and a third branch arm 803. A first end of the first branch arm 801 is coupled to the radiation element 301, the second branch arm 802 is parallel with the first branch arm 801 by a gap therebetween. A second end of the second branch arm 802 is coupled to the grounding element 303. A first end of the third branch arm 803 is coupled to the second end of the first branch arm 801. The second end of the third branch arm 803 is coupled to the first end of the second branch arm 802. The third branch arm 803 is vertical to the first branch arm 801 and the second branch arm 802, while the radiation element 301 is parallel with the grounding element 303. The signal wire 307 is coupled to the conductive pin 305 to receive and transmit signals.

The radiation element 301 is equally divided into five predetermined lengths L1, and one of the two adjacent predetermined lengths L1 is stretched outwards, so that the radiation element 301 protrudes outwards to form a sharp locus within the predetermined length. The protruding sharp locus is a first equilateral triangle locus whose side length equals the predetermined length described earlier.

According to the Koch fractal antenna design method, each section of the predetermined lengths L1 of the radiation element 301 is stretched outwards from its center, so that a second equilateral triangle locus is formed within one-third of each section's center of the predetermined length L1. The second equilateral triangle locus' side length equals one-third of the predetermined length L1. Accordingly, the second equilateral triangle may be further stretched for a plurality of times in the same manner.

In addition, each of the conductive pins 305 is also equally divided into three predetermined lengths L2, and one of two adjacent predetermined lengths L2 is stretched outwards, so that the branch arm is stretched outwards within the predetermined length L2 to form a protruding second sharp locus which is an equilateral triangle locus whose side length is equal to the predetermined length L2.

According to the Koch fractal antenna design method, each section of the predetermined lengths L2 of each of the branch arms is stretched outwards from its center, so that a third equilateral triangle locus is formed within one-third of each section's center of the predetermined length L2. The third equilateral triangle locus' side length is equal to one-third of the predetermined length L2. Accordingly, the sides of the third equilateral triangles may be further stretched for a plurality of times in the same manner. By stretching the radiation element 301, the operation frequencies of the inverted-F dual-band antenna can be adjusted, and thus the area occupied in such type of antenna may also be reduced efficiently.

In summary, the arrangement of Koch fractal antenna can be applied to the multi-band antenna according to the present invention. The multi-band antenna is designed in triangular shape whose area is smaller than the regular antenna. Meanwhile, by using the arrangement of Koch fractal antenna, a smaller inverted-F dual-band antenna can be designed to reduce its area required, so as to enhance usability.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A multi-band antenna, comprising:

a radiation element;

a grounding element, located at one side of the radiation element;

a conductive pin, comprising:

a first branch arm, having a first end coupled to the radiation element;

a second branch arm, isolated from the first branch arm, and having a second end coupled to the grounding element; and a third branch arm, having a first end coupled to a second end of the first branch arm, and the second end of the third branch arm being coupled to a first end of the second branch arm, wherein the third branch arm of the conductive pin is vertical to the first branch arm and the second branch arm of the conductive pin, and the first branch arm of the conductive pin is parallel to the second branch arm of the conductive pin; and a signal wire coupled to the conductive pin, for receiving and transmitting signals;

wherein the radiation element is equally divided into a plurality of predetermined lengths having the same length, and is subject to a fractal evolution within the predetermined lengths.

2. The multi-band antenna of claim 1, wherein the fractal evolution comprises N stages of stretching, each stage of stretching takes place at each of the straight line sections of the fractal radiation element, and the straight line section of every interval within the predetermined length is stretched vertically, so that a protruding sharp locus is formed on the predetermined length, wherein N is a positive integer.

3. The multi-band antenna of claim 2, wherein the protruding sharp locus is an equilateral triangle locus.

4. The multi-band antenna of claim 2, wherein the predetermined length is the length of the straight line section corresponding to each of the fractal radiation elements during the current stage stretching.

5. The multi-band antenna of claim 1, wherein the fractal radiation element is a micro-strip component.

6. The multi-band antenna of claim 1, where the radiation element is parallel to the grounding element.

7. The multi-band antenna of claim 1, wherein the first branch arm, the second branch arm, and the third branch arm are equally divided into a plurality of predetermined lengths having the same length, and are subject to a fractal evolution within the predetermined lengths.

* * * * *